US009144295B2

(12) United States Patent
Schmoll et al.

(10) Patent No.: US 9,144,295 B2
(45) Date of Patent: Sep. 29, 2015

(54) INTERCHANGEABLE DECORATIVE PANEL SYSTEM FOR SHOES, APPAREL, AND ACCESSORIES

(71) Applicants: Daniel T. Schmoll, Princeton, TX (US); Todd A. Miller, Tualatin, OR (US)

(72) Inventors: Daniel T. Schmoll, Princeton, TX (US); Todd A. Miller, Tualatin, OR (US)

(73) Assignee: Daniel T. Schmoll, Princeton, TX (US)

( * ) Notice: Subject to any disclaimer, the term of this patent is extended or adjusted under 35 U.S.C. 154(b) by 102 days.

(21) Appl. No.: 14/090,336

(22) Filed: Nov. 26, 2013

(65) Prior Publication Data

US 2014/0147618 A1 May 29, 2014

Related U.S. Application Data

(60) Provisional application No. 61/730,255, filed on Nov. 27, 2012.

(51) Int. Cl.

| | |
|---|---|
| ***A43B 23/24*** | (2006.01) |
| ***A45F 5/02*** | (2006.01) |
| ***A43B 1/00*** | (2006.01) |
| ***A43B 3/00*** | (2006.01) |

(Continued)

(52) U.S. Cl.

CPC ..... *A45F 5/02* (2013.01); *A43B 1/0081* (2013.01); *A43B 3/0078* (2013.01); *A43B 23/24* (2013.01); *A41D 27/08* (2013.01); *A44C 1/00* (2013.01); *A45F 2003/001* (2013.01); *Y10T 428/24008* (2015.01); *Y10T 428/24017* (2015.01)

(58) Field of Classification Search

CPC ..... A43B 3/0078; A43B 23/24; A41D 27/08

USPC ..... 428/99; 40/636, 660; 36/136

See application file for complete search history.

(56) References Cited

U.S. PATENT DOCUMENTS

| | | | |
|---|---|---|---|
| 3,600,761 | A | 8/1971 | Mathey |
| 3,601,909 | A | 8/1971 | Amendola |

(Continued)

FOREIGN PATENT DOCUMENTS

| | | | |
|---|---|---|---|
| CN | 202194906 | U | 4/2012 |
| DE | 3801527 | A1 | 8/1988 |

(Continued)

OTHER PUBLICATIONS

International Search Report, and Written Opinion of the International Searching Authority, International Application No. PCT/US2013/071944 (Rospatent, Mar. 13, 2014).

(Continued)

*Primary Examiner* — Alexander Thomas

(74) *Attorney, Agent, or Firm* — Anderson & Levin, L.L.P.

(57) ABSTRACT

A system for removably attaching a decorative element to a garment or other accessory, including a panel bearing a graphic design, and a pair of mounting pads to which the panel can be attached. First and second pin members are disposed at opposing edges of the panel, each pin member having a pin extending for a length parallel to that edge. The mounting pads are attachable to a garment or accessory item. Each mounting pad has a longitudinal tunnel suitable to accommodate one of the pins. The mounting pads may be attached on the outside of an article, or on the interior of an article so that only the tunnel is exposed at the exterior of the article, in a recessed manner. The system allows a decorative panel to be interchangeably facilitates their attachment to a wide range of apparel and accessory items.

17 Claims, 11 Drawing Sheets

(51) Int. Cl.

| | |
|---|---|
| *A41D 27/08* | (2006.01) |
| *A44C 1/00* | (2006.01) |
| *A45F 3/00* | (2006.01) |

(56) References Cited

U.S. PATENT DOCUMENTS

| | | | | |
|---|---|---|---|---|
| 4,296,559 | A | 10/1981 | Gamm | |
| 4,610,102 | A | 9/1986 | Hill | |
| 4,611,416 | A | 9/1986 | Lin | |
| 4,697,362 | A | 10/1987 | Wasserman | |
| 4,852,276 | A | 8/1989 | Savoca et al. | |
| 5,359,790 | A | 11/1994 | Iverson et al. | |
| 5,459,947 | A | 10/1995 | Lasher | |
| 5,555,659 | A | 9/1996 | Hade | |
| 5,970,516 | A | 10/1999 | Shimooka | |
| 7,219,445 | B2 * | 5/2007 | Stern et al. | 36/11.5 |
| 2001/0034894 | A1 | 11/2001 | Godfrey et al. | |
| 2003/0026947 | A1 | 2/2003 | Piligian | |
| 2005/0284005 | A1 | 12/2005 | Snyder | |
| 2009/0019731 | A1 | 1/2009 | Braynock et al. | |
| 2009/0044430 | A1 | 2/2009 | Philpott | |
| 2011/0271558 | A1 | 11/2011 | Rosko et al. | |

FOREIGN PATENT DOCUMENTS

| | | | |
|---|---|---|---|
| GB | 2200178 | A | 7/1988 |
| RU | 14306 | U1 | 7/2000 |
| RU | 86780 | U1 | 9/2009 |
| WO | 01/35382 | A1 | 5/2001 |

OTHER PUBLICATIONS

English language translation of the Abstract of CN 202194906 U, as available via Espacenet from the European Patent Office, Apr. 2012.
English language translation of the Abstract of DE 3801527 U, as available via Espacenet from the European Patent Office, Aug. 1988.

* cited by examiner

INTERCHANGEABLE DECORATIVE PANEL SYSTEM FOR SHOES, APPAREL, AND ACCESSORIES

CROSS-REFERENCE TO RELATED APPLICATIONS

This application claims priority, under 35 U.S.C. §119(e), of Provisional Application No. 61/730,255, filed Nov. 27, 2012, incorporated herein by this reference.

STATEMENT REGARDING FEDERALLY SPONSORED RESEARCH OR DEVELOPMENT

Not applicable.

BACKGROUND OF THE INVENTION

This invention is in the field of decorative and ornamental items to be worn on clothes or displayed on accessories. Embodiments of the invention are more specifically directed to interchangeable items, such as are suitable for affiliation, affinity, or artistic expression by the wearer.

As evident in modern society, many people, including children and adults, enjoy wearing clothes, hats, shoes, and other garments or apparel that bear logos or graphics of athletic teams, schools, celebrities, fictional characters, brands of goods (e.g., automobiles), and other items or institutions with which the wearer has some affinity. These logos and graphics also appear on items other than apparel, such as backpacks, golf bags and other types of bags and luggage, chairs and seat cushions, and countless others. Typically, these logos and graphics are printed or sewn directly onto the item, permanently marking the item in that fashion. To display a different logo or graphic, the customer is thus required to purchase a new item.

It has also been observed, in connection with this invention, that children also enjoy the collecting and trading of various items. In particular, it has been observed that this enjoyment is particularly acute for similar items of differing appearance, especially different graphics. Such items as trading cards, action figures, come to mind as examples of collected and traded items among children. In addition, children also enjoy displaying their affinity with sports teams, entertainers, cartoon characters, and their schools. Of course, the cost of acquiring each new garment or item that is introduced with a different logo or graphic of interest to a child can quickly mount up, especially when coupled with the rate at which children of a certain age outgrow their clothes.

Garments and other items that bear a graphics or logo typically carry a price premium relative to similar items that do not display the graphics or logo, if for no other reason than the additional licensing fee to be paid by the manufacturer.

BRIEF SUMMARY OF THE INVENTION

Embodiments of this invention provide an attachment system by way of which decorative panels can be securely attached to and removed from a wide range of items of clothing, luggage, backpacks, and other such items.

Embodiments of this invention provide such a system that enables the use of a single item on various items of clothing, luggage, backpacks, etc.

Embodiments of this invention provide such a system that may be constructed with a minimal number of sizes, to facilitate manufacture and to encourage re-use of the ornamental panels.

Embodiments of this invention provide such a system that allows the decorative panel to stretch to some extent, without distorting the displayed logo, image, or graphics.

Embodiments of this invention provide such a system that enables the same decorative panel to be used on different garments and accessory items.

Embodiments of this invention provide such a system that encourages the collecting and trading of the ornamental panels, while still permitting frequent use of the panels.

Other objects and advantages of embodiments of this invention will be apparent to those of ordinary skill in the art having reference to the following specification together with its drawings.

An embodiment of this invention may be implemented into a system for removably attaching a decorative element to a garment or other accessory, including a panel bearing a design, and a pair of mounting pads to which the panel can be attached. The panel has first and second pin members disposed at its opposing parallel edges, each pin member having a pin extending for a length parallel to that edge. The mounting pads are attachable to a garment or accessory, and each has a longitudinal tunnel extending from its surface of a length suitable to accommodate one of the pins. The tunnels each have an opening at an end for receiving the pin, by way of which the panel can be attached and later removed.

Another embodiment of the invention may be implemented into a panel bearing a graphic design, and a pair of mounting pads to which the panel can be attached. The panel has first and second pin members disposed at its opposing parallel edges, each pin member having a pin extending for a length parallel to that edge. This construction of the panels facilitates their attachment to a wide range of apparel and accessory items.

DETAILED DESCRIPTION OF THE INVENTION

Figure 1A:
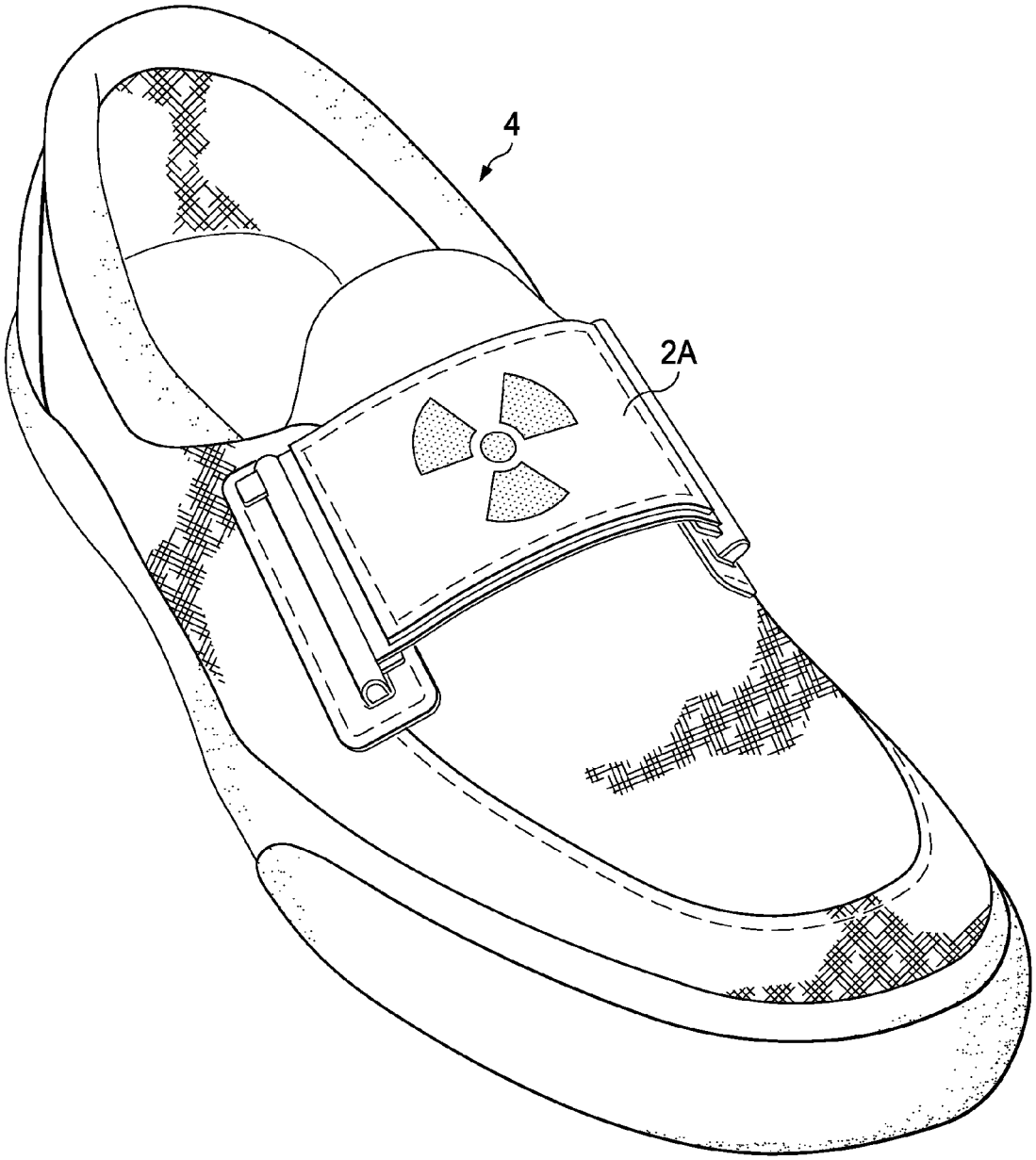
FIGS. 1*a* and 1*b* are perspective views of a shoe illustrating the attachment of a decorative panels according to an embodiment of the invention.

This invention will be described in connection with its embodiment, namely as implemented for attachment to shoes, apparel and accessory items, and the like, as it is contemplated that the invention is particularly beneficial when used in those applications. However, it is contemplated that this invention can also provide benefits when implemented in other realizations other than those described in this specification. Accordingly, it is to be understood that the following description is provided by way of example only, and is not intended to limit the true scope of this invention as claimed.

As discussed above in connection with the Background of the Invention, many consumers enjoy wearing and using apparel and accessory items on which decorative graphics and logos are displayed. The decorative graphics and logos express affinity on the part of the wearer or user with the subject of the design, such as in the case of a sports team or school, or may simply be expressive in an artistic way by displaying a pleasing or otherwise expressive image.

According to embodiments of this invention, the expressive design is applied to interchangeable panels that are removably attachable to the article, rather than to the article itself. As will become apparent from the following description, these panels can be readily and quickly removed, and replaced with other panels of the same size and shape but with a different appearance such as a different logo or graphic. The system provided by embodiments of this invention allows the other articles to have a different look as often as desired by the user, at a reasonable cost compared with purchasing entirely new clothing or accessory items to convey a different expression.

For purposes of this description, the term "design" will be used to refer to any of a variety of designs, logos, graphics, text, and the like, including but not limited to licensed sports team logos; logos or graphics associated with schools, television programs and movies, restaurants, shops, brands and logos for goods, and the like; logos or likenesses of characters such as professional athletes, entertainers, celebrities, fictional or cartoon characters, and the like; patterns, fashions, and other types of images including those that may be created by the user or wearer, and other custom images; and also ornamentation such as sequins, faux rhinestones, costume jewelry, pins, and the like. It is contemplated that those of ordinary skill having reference to this specification will be readily able to identify other expressive features that may alternatively be used in connection with embodiments of this invention, and that such alternative features being within the scope of this invention as claimed.

For purposes of this description, the term "article" will be used to refer to any of a number of apparel and accessory items, including apparel items such as shoes, hats, caps, jackets, shirts, jeans and other trousers, skirts, hair bows, headbands, and other garments; and accessory items such as purses, backpacks, carry bags, golf bags, duffel bags, computer cases, lunch boxes, tote bags, gear bags, gym bags, school binders, hair bows, headbands, stadium chairs, and the like. It is contemplated that those of ordinary skill having reference to this specification will be readily able to identify other articles and items to and with which embodiments of this invention may alternatively be applied and used, and that such alternative articles, items, applications, and uses being within the scope of this invention as claimed.

Figure 1B:
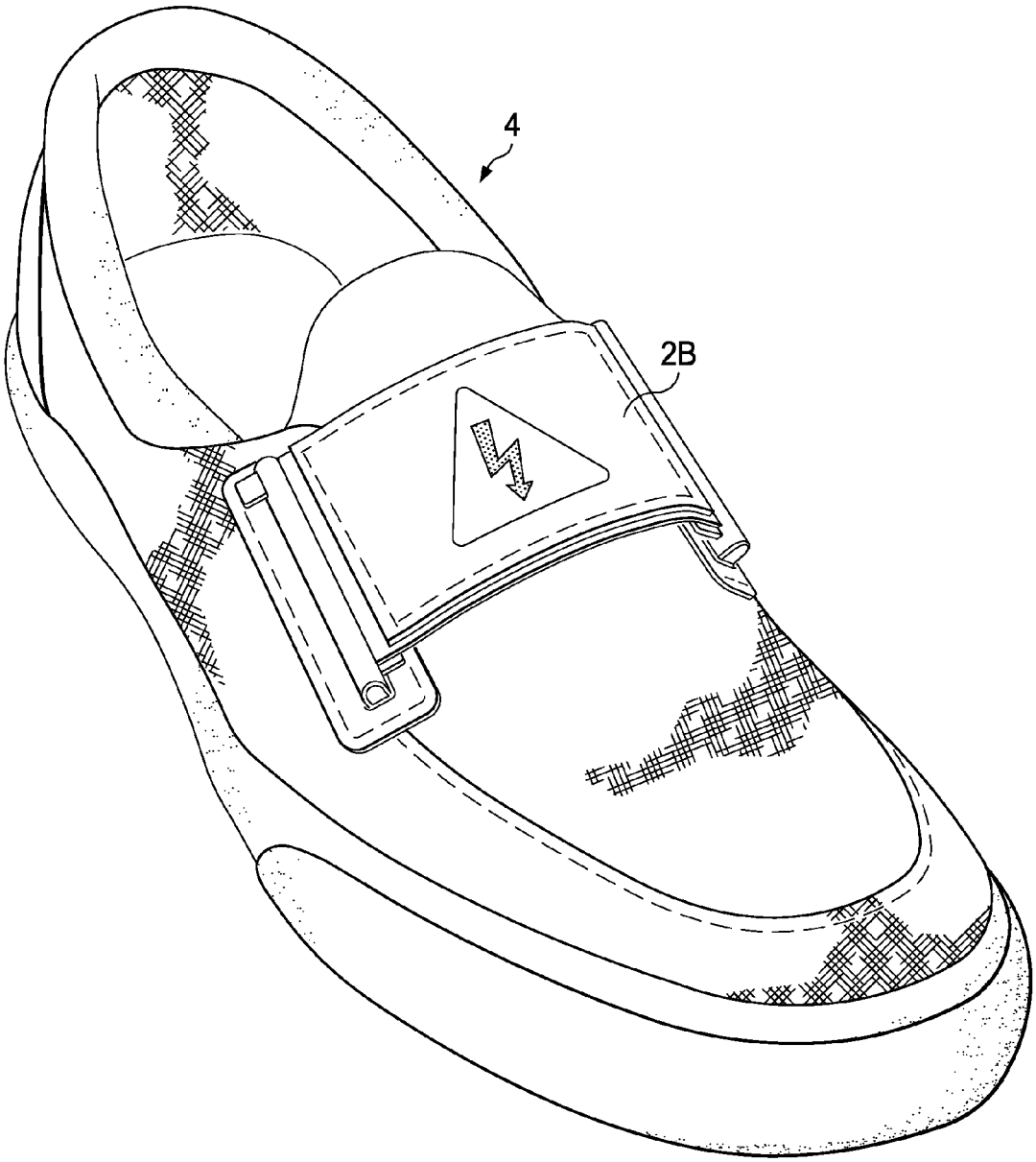

FIGS. 1*a* and 1*b* illustrate an implementation of an embodiment of the invention, for the example of a shoe as the article upon which removable panels bearing a design can be installed and removed. In FIGS. 1*a* and 1*b*, shoe 4 is of a slip-on type, upon which removable panels 2*a*, 2*b* are respectively installed. FIG. 1*a* illustrates shoe 4 with removable panel 2*a*, bearing a school logo design, attached thereto at a location overlying the shoe upper at the top of the instep. FIG. 1*b* illustrates the same shoe 4 with different removable panel 2*b* (i.e., different in the sense that it is displaying a different design) attached to the shoe upper at the top of the instep, in the sample place as panel 2*a* of FIG. 1*a*. According to embodiments of this invention, the system for attaching the removable panels 2*a*, 2*b* to shoe 4 facilitates rapid and easy removal and installation, while securely retaining panels 2*a*, 2*b* once installed.

Figure 2A:
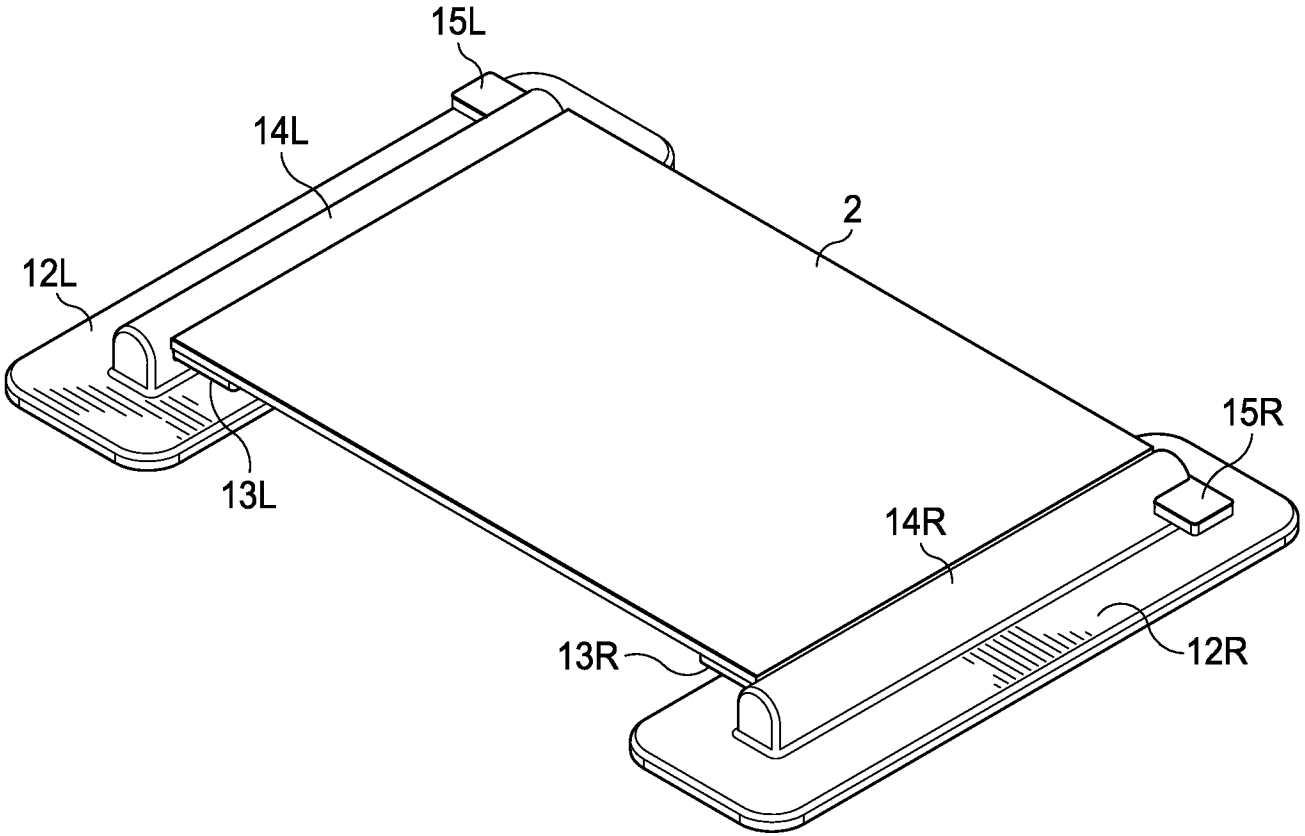
FIG. 2*a* is a perspective view of the decorative panel system according to an embodiment of the invention, illustrating the panel as attached to mounting pads.

FIGS. 2*a* through 2*g* illustrate a panel attachment system according to a first embodiment of the invention, referred to herein as a "pin and tunnel system". More specifically, FIG. 2*a* is a perspective view of a panel and attachment system, as suitable for installation and use on an article, such as shoe 4 described above. Panel 2 will bear the desired design to be displayed when installed on the article, although none is shown in FIG. 2*a* for the sake of clarity. In this embodiment of the invention, panel 2 is of a rectangular shape, with its parallel sides, namely its left-hand and right-hand edges, attached to flat portions 13L, 13R of pin members that are retained within tunnels 14L, 14R, respectively. Tunnels 14 (collectively referring to tunnels 14L, 14R) are unitary with and extend above mounting pads 12 (collectively referring to mounting pads 12L, 12R), in this embodiment of the invention. The placement of mounting pads 12 at shoe 4 defines a spacing between tunnels 14 corresponding to the width of panel 2, and aligns tunnels 14 sufficiently parallel to one another to facilitate installation of panel 2.

Mounting pads 12 are constructed of a shape suitable to be attached or otherwise mounted to the article upon which panel 2 is to be displayed. In this embodiment of the invention, mounting pads 12 are attached to the article during the manufacture of the article itself. Alternatively, as will be described in detail below in connection with another embodiment of the invention, mounting pads 12 may be constructed so as to be hidden under the top surface of fabric or another portion of that article. Referring back to the embodiment of the invention shown in FIG. 2*a*, tabs 15L, 15R extend from the pins (not visible) to which panel 2 is attached, to facilitate the installation and removal of panel 2 from the article, and to secure panel 2 to the article when installed, as will be described below.

Figure 2B:
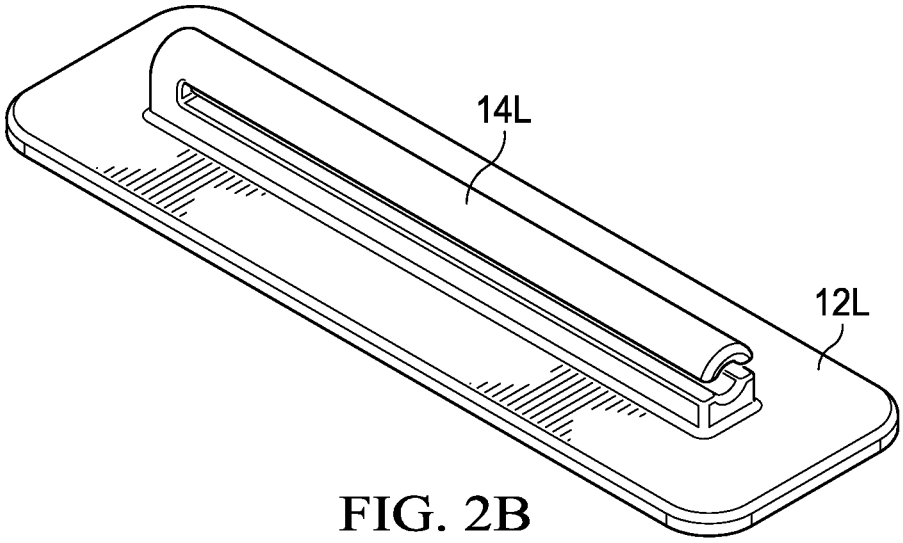
FIG. 2*b* is a perspective view illustrating a mounting pad of the system of FIG. 2*a* according to an embodiment of the invention.

FIG. 2*b* illustrates, in perspective view, mounting pad 12L and its tunnel 14L. The orientation of the perspective view of FIGS. 2*b* through 2*g* is reversed from that of FIG. 2*a*, showing mounting pad 12L and tunnel 14L from its top edge as shown in FIG. 2*a*. As evident from FIG. 2*b*, the interior of tunnel 14L is open at its top end (at the right end in the view of FIG. 2*b*) and closed at its bottom end (at the left end in the view of FIG. 2*b*), so as to receive a pin from its open end and retain that pin when fully inserted. In this embodiment of the invention, this interior slot of tunnel 14L is tapered from its widest at the top opening to its narrowest at its closed end, to better retain such an inserted pin. Mounting pad 12L and tunnel 14L in this embodiment of the invention are constructed so as to be unitary with one another, for example from a flexible plastic material so that both can flex as the article to which it is attached flexes. Alternatively, if mounting pad 12L is to be mounted to an articles that does not require a flex, it could be constructed from any one of a variety of other suitable materials that may enhance the aesthetics, durability, or both of the system when installed. In this embodiment of the invention, tunnel 14L has a slit along its side that runs nearly its entire length, for accommodating flat portion 13L (not shown in FIG. 2*a*) and the material of panel 2 when installed with its pin within tunnel 14L.

As evident from FIG. 2*a*, corresponding mounting pad 12R and its tunnel 14R will be similarly constructed as mounting pad 12L and tunnel 14L, but will have the opposite orientation, for receiving the opposite edge of panel 2.

Figure 2C:
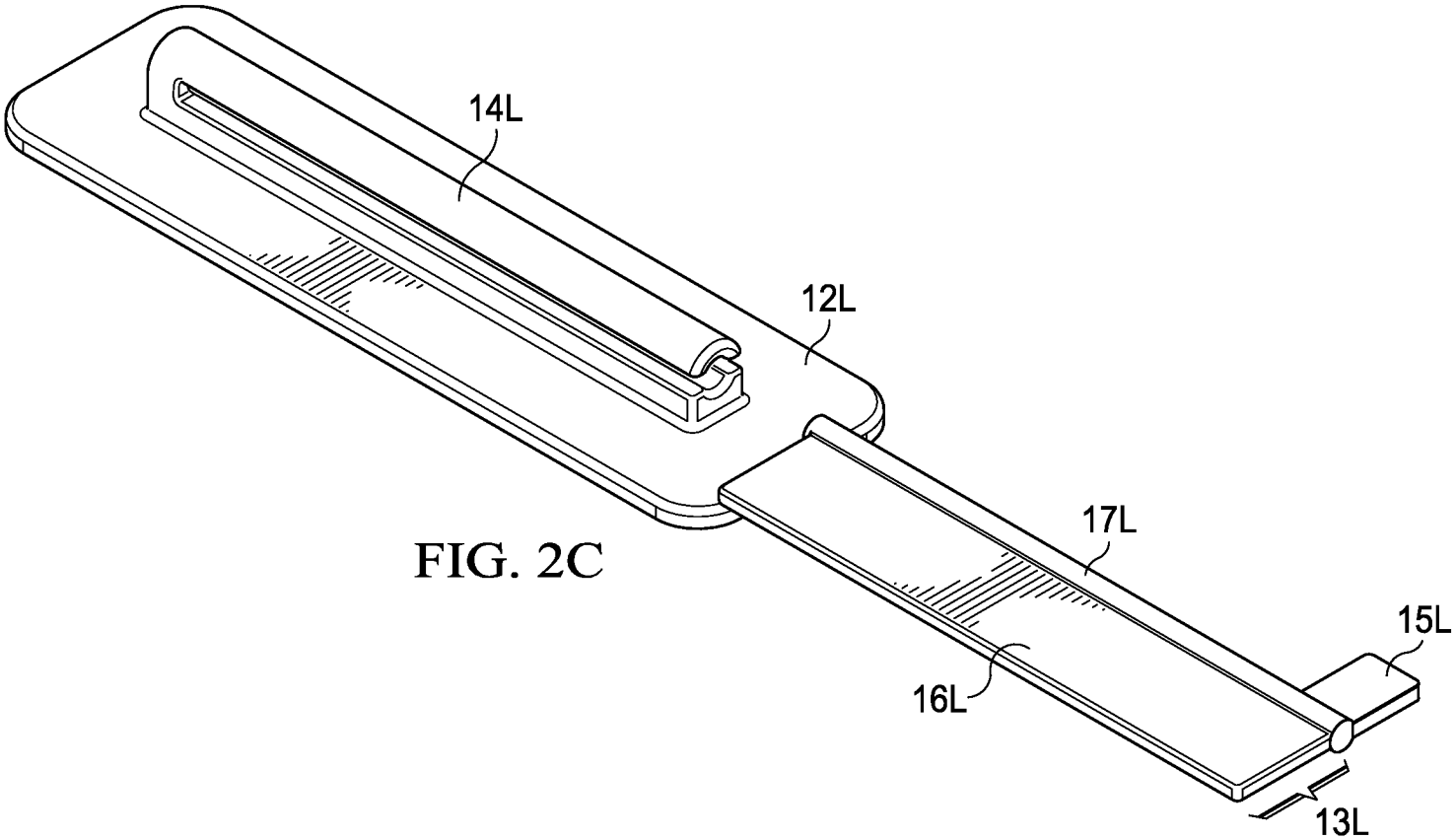
FIG. 2*c* through 2*e* are perspective views illustrating the mounting pad of FIG. 2*b* and a pin member of a decorative panel, at stages of the attachment of the panel to the mounting pad according to an embodiment of the invention.

FIG. 2*c* illustrates the construction of pin member 16L that mates with tunnel 14L according to this embodiment of the invention. Pin member 16L has flat portion 13L to which panel 2 (not shown in FIG. 2*c*) is sewn, glued, or otherwise attached as shown in FIG. 2*a*, and an enlarged portion along one edge defining pin 17L. Tab 15L is formed at one end of that pin 17L, extending from pin 17L in a direction opposite from that of flat portion 13L. In this embodiment of the invention, pin 17L has a circular cross-section, with a diameter that tapers from its widest at the tab 15L end to its narrowest at the opposite end, in a manner corresponding to the taper of the interior of tunnel 14L as described above relative to FIG. 2*b*, to aid in alignment during insertion and for secure retention within tunnel 14L. Preferably, pin 17L is slightly smaller than its corresponding tunnel 14L so as not to bind during removal or installation of panel 2, but yet having a size so as to fit snugly when fully inserted into tunnel 14L. Pin member 16L is preferably constructed from a flexible plastic material so as to be unitary with pin 17L and tab 15L.

A corresponding pin member 16R, having pin 17R and tab 15R, will be similarly constructed as pin member 16L, for attachment to an opposite side of panel 2 so as to be oriented in the opposite direction from pin member 16L, as evident from FIG. 2*a*.

Figure 2D:
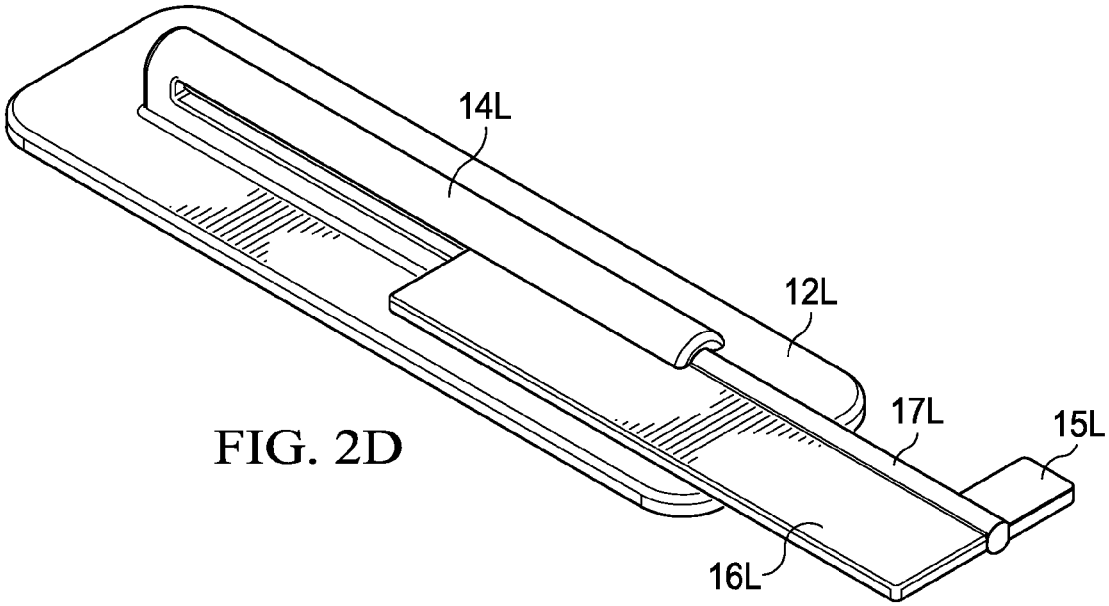
Figure 2E:
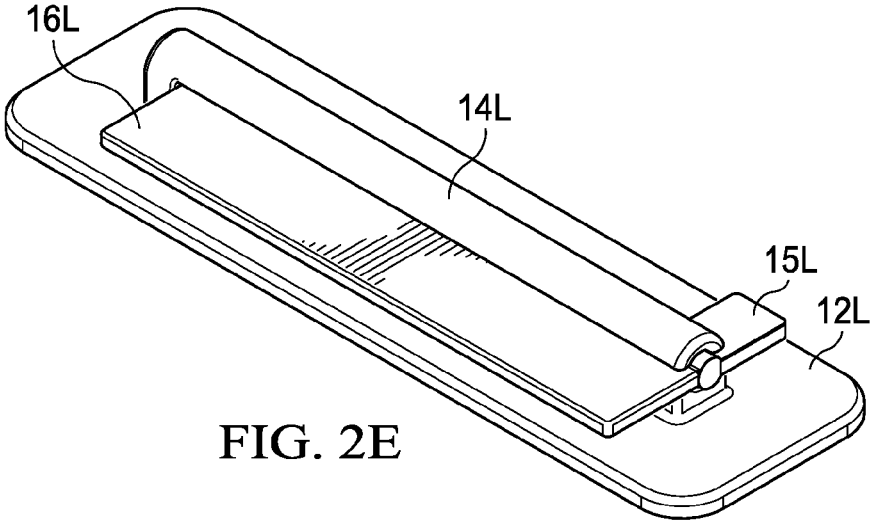

FIGS. 2*d* and 2*e* illustrate the insertion of pin 17L into tunnel 14L, with FIG. 2*d* showing partial insertion, and FIG. 2*e* illustrating completed insertion. During this insertion process, of course, panel 2 (not shown) will be sewn or otherwise attached to the flat portion of pin member 16L, and to the flat portion of a corresponding pin member 16R. Pins 17L, 17R of both pin members 16L, 16R will be simultaneously inserted into tunnels 14L, 14R, respectively, on both sides of panel 2, and then slid downward (in this example) along the length of tunnels 14. As mentioned above, mounting pads 12 are placed on the article such that tunnels 14 are sufficiently parallel to one another as to facilitate the simultaneous insertion and sliding of pins 17 into and along tunnels 14, at a spacing of tunnels 14 corresponding to the width of panel 2. Upon completion of the insertion of pins 17L, 17R into their respective tunnels 14L, 14R, one can envision from FIG. 2*e* that panel 2 will be extended across a portion of the article to display its design, such as shown for the example of shoe 4 of FIGS. 1*a* and 1*b*.

Figure 2F:
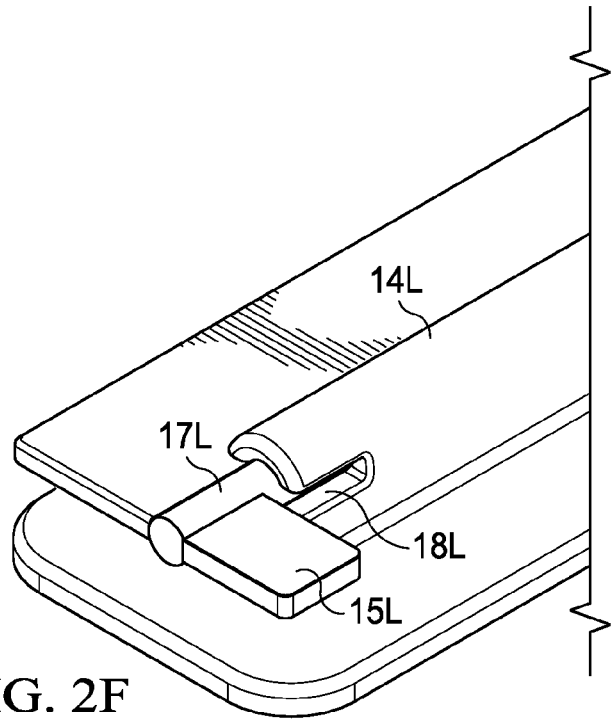
FIGS. 2*f* and 2*g* are perspective views illustrating a locking arrangement of the pin member into a corresponding tunnel of a mounting pad, according to an embodiment of the invention.
Figure 2G:
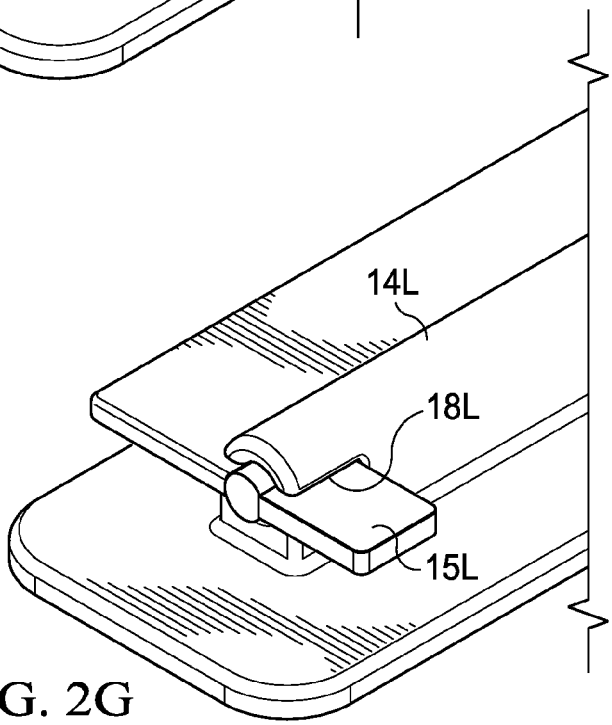

According to this embodiment of the invention, tabs 15 serve two functions. First, tabs 15 serve as handles or grippers for the user during insertion and removal of pins 17 into and out from tunnels 14. In particular, tabs 15 will enable the user to use his or her fingertips to pull both pin members 16 outward to retract pins 17 from tunnels 14 when removing panel 2 from the article. Another function of tab 15 is to ensure a tight fit upon pins 17 being fully inserted into tunnels 14. FIGS. 2*f* and 2*g* illustrate this second function in connection with tab 15L. As shown in the perspective views of FIGS. 2*f* and 2*g*, which are oriented from the opposite side of tunnel 14L as FIGS. 2*d* and 2*e*, tab 15L mates into slot 18L at the open end of tunnel 14L. It is contemplated that slot 18L will slightly flex open as tab 15L is inserted, as shown in FIG. 2*g*, providing a pressure fit to secure pin 17L within tunnel 14L. Pin 17R and tunnel 14R will of course be similarly constructed.

In addition, pins 17 may each have a raised bead along its cylindrical surface, near their respective tabs 15, in combination with tunnels 14 each including a recess along its interior surface at a location corresponding to full insertion of its pin 17. This bead and recess combination provides another locking feature for the system.

Figure 2H:
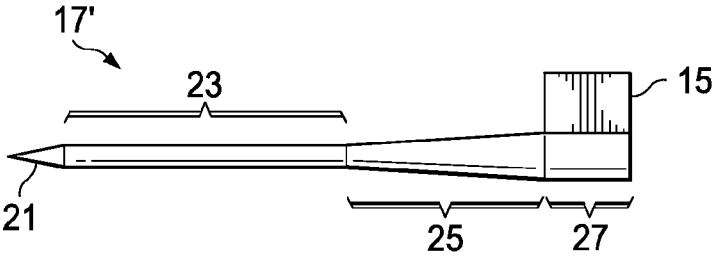
FIG. 2*h* is an elevation view of a pin according to another embodiment of the invention.

Alternatively to the construction described above, the taper of pin 17 may vary along its length, with its corresponding tunnel 14 having sections of its interior slot with corresponding varying tapers. FIG. 2*h* illustrates the construction of pin 17' as an example of this alternative implementation. In this example, pin 17' has a relatively sharply pointed end 21, which facilitates the initial insertion of pin 17' into tunnel 14, followed by a relatively straight section 23. Tapered portion 25 begins near the middle of the length of pin 17' and extends up to straight portion 27 at the end of pin 17', with tab 15 connected to this straight portion 27 as shown. As mentioned above, tunnel 14 would be constructed to match the contour and shape of 17'. It is contemplated that this varying taper can aid in the securing of panel 2 in place on the article, while also aiding the installation of panel 2 by facilitating proper alignment of pin 17' into its tunnel 14.

Further in the alternative, pin 17 may have a constant cross-sectional diameter over nearly its entire length, narrowed to a point at one end to align its insertion into tunnel 14, and a wider portion at its trailing end for retention of pin 17 in its tunnel 14. Corresponding tunnel 14 may have a narrower inside diameter at its two ends, to provide a friction grip on pin 17 in this alternative arrangement. This construction of pin 17 can help to ensure that it stays within tunnel 14 during insertion, without slipping out of the slit in tunnel 14 provided for panel 2. It is further contemplated that other variations and alternatives to the shape and size of pin 17 will be apparent to those of ordinary skill in the art having reference to this specification.

In the embodiment of the invention shown in FIGS. 1*a* and 1*b*, mounting pads 12 are attached to the outer surface of the upper of shoe 4. In that embodiment of the invention, mounting pads 12 would thus be exposed and visible if panels 2*a*, 2*b* were not installed. According to another embodiment of the invention, mounting pads are constructed for attachment to the article, such as shoe 4, so as to be recessed and essentially invisible if the decorative panel is not installed. In addition, while the location of panels 2*a*, 2*b* is on the top of the shoe upper in these examples, it is contemplated that the system may be incorporated at other locations of the shoe.

Figure 3A:
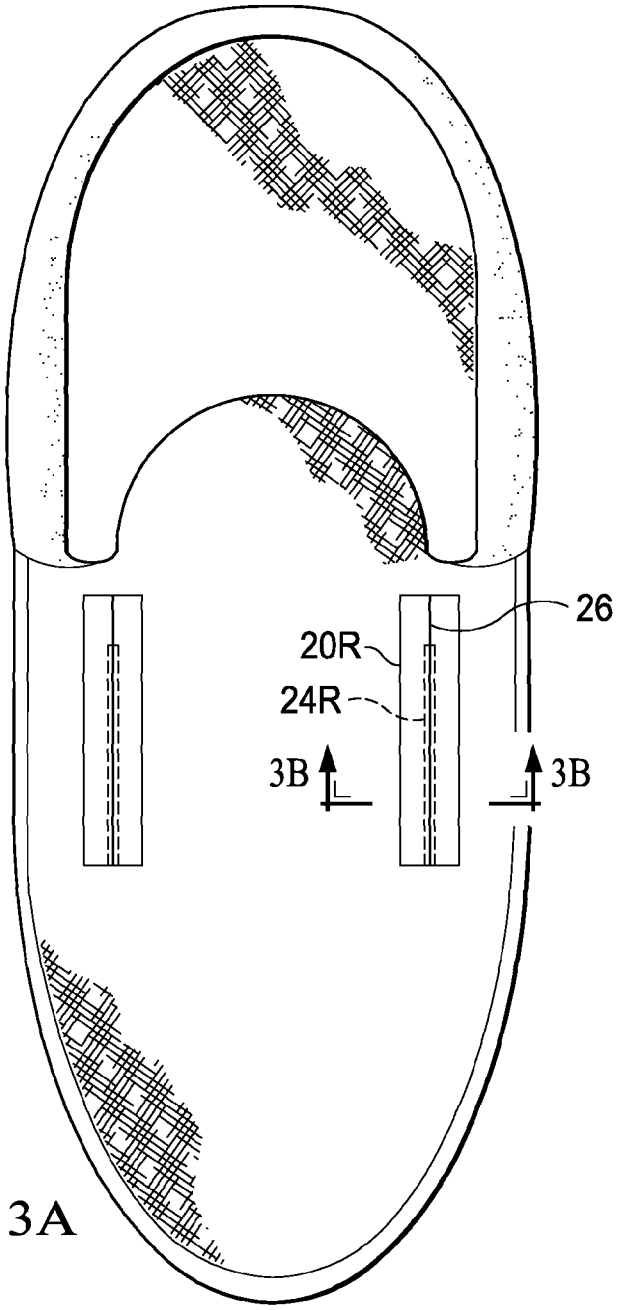
FIGS. 3*a* and 3*b* are plan and cross-sectional views, respectively, of a mounting pad as installed at an upper of a shoe, according to another embodiment of the invention.
Figure 3B:
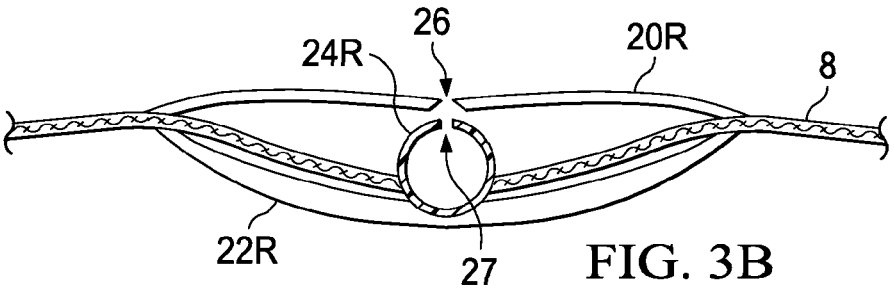

FIGS. 3*a* and 3*b* illustrate the construction and installation of a system according to this embodiment of the invention, which will now be described with reference to tunnel 24R at shoe 4 as shown in FIG. 3*a*; it is of course contemplated that corresponding tunnel 24L will be of similar construction at the opposing location of the upper of shoe 4. In this example, flaps 20R of material (e.g., fabric) are sewn or otherwise attached to the top surface of the upper of shoe 4 at one location; corresponding flaps 20L are of course formed at an opposing location as shown. Slit 26 between flaps 20R allow access to tunnel 24R underlying flaps 20R. As evident from FIG. 3*a*, slit 26 extends for a distance beyond one end of tunnel 24R, to facilitate insertion of a corresponding pin 17R into tunnel 24R from that end.

As shown in cross-section in FIG. 3*b*, mounting pad 22R (and, of course, a similar mounting pad 22L, not shown) is installed behind material 8 of shoe 4; in other words, material 8 of shoe 4 is sewn or otherwise attached at the frontside of mounting pad 22R. Mounting pad 22R is formed of a relatively stiff plastic material, with tunnel 24R extending from one surface. As shown in FIG. 3*b*, tunnel 24R extends through material 8 of the upper of shoe 4. In this embodiment of the invention, mounting pad 22R is nominally curved so that tunnel 24R is recessed into shoe 4; as a result, material 8 and flaps 20R form a smooth top surface of shoe 4, with tunnel 24R recessed so as not to protrude from that surface. In the recessed panel implementation as in FIG. 3*a*, it is contemplated that the area of the upper at which tunnels 24 and panel 2 are to be installed may be further recessed as a whole, so that panel 2 is flush with the rest of the shoe upper when installed, providing a smooth, even, look. The curvature of mounting pad 22R may vary according to its intended use. For example, mounting pad 22R has a curvature corresponding to its application to shoe 4, which itself has a curved surface; this curvature may be more pronounced for other articles that have a flat surface, such as a backpack. In each case, the curvature of mounting pad 22R is intended to sufficiently recess its tunnel 24R under the outer surface of the article. In any case, it is contemplated that mounting pad 22R will be constructed of a material having some flexibility, to allow it to conform to the shape of the article, and flexure of that article during its use.

In this embodiment of the invention, tunnels 24 are contemplated to be fully enclosed within corresponding flaps 20, with slit 27 disposed at a top edge of tunnel 24 to accommodate the portions of pin members 16 to which the fabric of panel 2 is attached. As such, it is contemplated that tabs (such as shown in FIGS. 2*c* through 2*h*) may not be provided at the ends of the pins and pin members, as there may not be room for such a tab to extend from the surface of the article, given the recessed and buried nature of tunnels 24. In that case, a friction grip may be provided at the end of the corresponding pins 17 to improve retention within tunnels 24; alternatively or in addition, pins 17 may have a raised bead along its cylindrical surface, to mate with recesses in tunnels 24, when fully inserted, as described above.

According to this embodiment of the invention, as shown in FIG. 3*a*, the interchangeable panel system can be implemented on shoe 4 or another article so as to look only slightly different, when panel 2 is not attached, from similar articles that do not accommodate the system.

An important benefit of the panel system of this embodiment of the invention is its compatibility with lace up shoes. In that implementation, panel 2 can be installed to overlie the shoelaces. Non-lace-style shoes, such as loafers or other slip-on shoes can be constructed to accommodate an outer panel placement in the manner shown in FIGS. 1*a* and 1*b*, or with a recessed panel placement as in the embodiment of the invention shown in FIG. 3*a*. It is contemplated that this recessed panel design can also be used in removable panel systems implemented on other articles, including apparel and accessories.

According to embodiments of this invention as applied to shoes, it is contemplated that the placement of mounting pads 12, 22 and corresponding tunnels 14, 24 on the shoe uppers can be maintained constant by the shoe manufacturers, for example according to a specification, over a wide range of shoe sizes and styles. More specifically, while tunnels 14, 24 may have a different placement on differently sized shoes from the standpoint of appearance, the spacing between the left-hand tunnels 14L, 24L and the right-hand tunnels 14R, 24R, can be kept uniform to accommodate a uniform size of panel 2. This consistent spacing would allow one size of panel 2 to fit shoes of a wide range of sizes. For example, it is contemplated that only two panel sizes (e.g., child and adult sizes) may be necessary to fit all common shoe sizes—one size may be provided for children (i.e., toddlers to preteens), and a second size for young adult to men's large sizes.

Alternatively, panel 2 may be constructed of a stretch material, such as an elastic or other stretch rubber type material, particularly for the fabric on either sides of a non-stretch portion that bears the design. This stretching of the panel also aids the panel in contouring to the arc of the top of the shoe, resulting in its placement in "perfect" position (i.e., without wrinkling or buckling). The stretchability of the fabric can allow for some variation in the placement of mounting pads 12, 22 over a range of shoes, while the non-stretch portion prevents distortion of the design due to this stretching, as all of the stretching of panel will occur in the elastic material on either side of the design portion of the panel.

In addition, it is contemplated that blank panels 2 can be provided for the removable panel system according to embodiments of this invention, to enable personalized or user-created customization of shoes, apparel, accessories, and other articles, for example by way of an iron-on patch that can adhere to the blank panel. It is further contemplated that stickers, removable adhesive-type labels, static-cling labels, and the like may be provided, for example in the form of sheets that can be printed upon by a laser or ink jet printer, to facilitate user-created designs, for example designs created by the user by way of an online design website.

According to another embodiment of the invention, as will now be described in connection with FIGS. 4*a* through 4*d*, the interchangeable panel system is constructed so as to be installable on existing articles. This allows the user to enjoy the benefits of the interchangeable panel system according to this invention on articles that he or she currently owns, rather than necessitating the purchase of new and specific shoes, backpacks, jeans, or other articles having the manufacturer-installed mounting pads 12, 22.

Figure 4A:
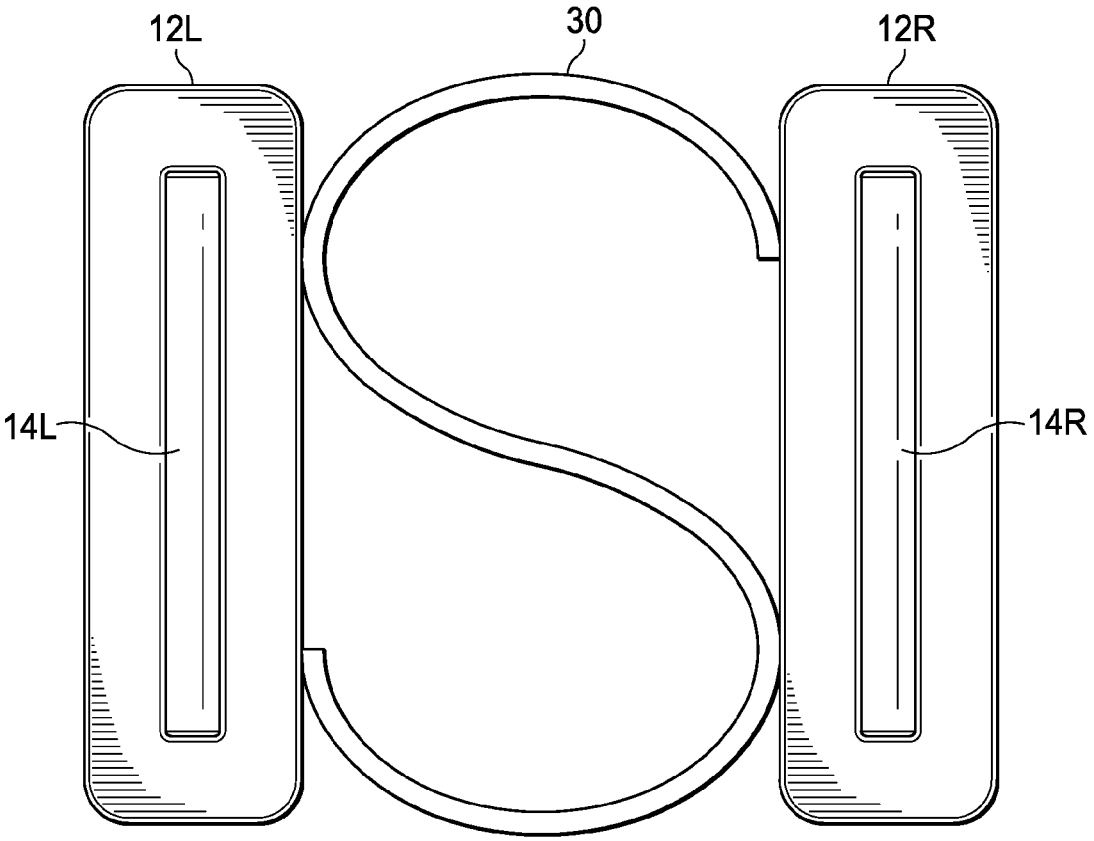
FIGS. 4*a* and 4*b* are plan views of mounting pad systems suitable for attachment by a user to a garment or accessory item, according to another embodiment of the invention.

FIG. 4*a* illustrates a first example of this embodiment of the invention, in which mounting pads 12L, 12R are attached to brace 30. Brace 30 defines the distance separating tunnels 14L, 14R from one another, and also maintains tunnels 14L, 14R in a parallel alignment relative to one another. As such, brace 30 ensures that a corresponding panel 2 of a common size can be installed. In this example, brace 30 is an s-shaped plastic member, and is preferably flexible to an extent that allows it to conform to articles of varying shape.

In this embodiment of the invention, mounting pads 12L, 12R or brace 30, or both, are intended to be attached to an article in any one of a number of conventional ways. For example, an adhesive may be present on the backside of either or both of brace 30 and mounting pads 12L, 12R (e.g., covered by a removable protective film prior to installation), so that the user can attach mounting pads 12L, 12R to any suitable article as desired. Either or both of brace 30 and mounting pads 12L, 12R may alternatively be provided with "iron-on" adhesive on the back, so as to adhere to an article on the application of heat. Other conventional adhesive systems may alternatively be used.

In some implementations, brace 30 is constructed of a transparent or translucent material, so as not to be visible when attached to an article. Alternatively, brace 30 may be constructed of an opaque material considering that a panel 2 will be disposed over it when installed. It is contemplated that brace 30 may either remain in place when attached to the desired article, or alternatively brace 30 may be cuttable from mounting pads 12L, 12R after installation.

Figure 4B:
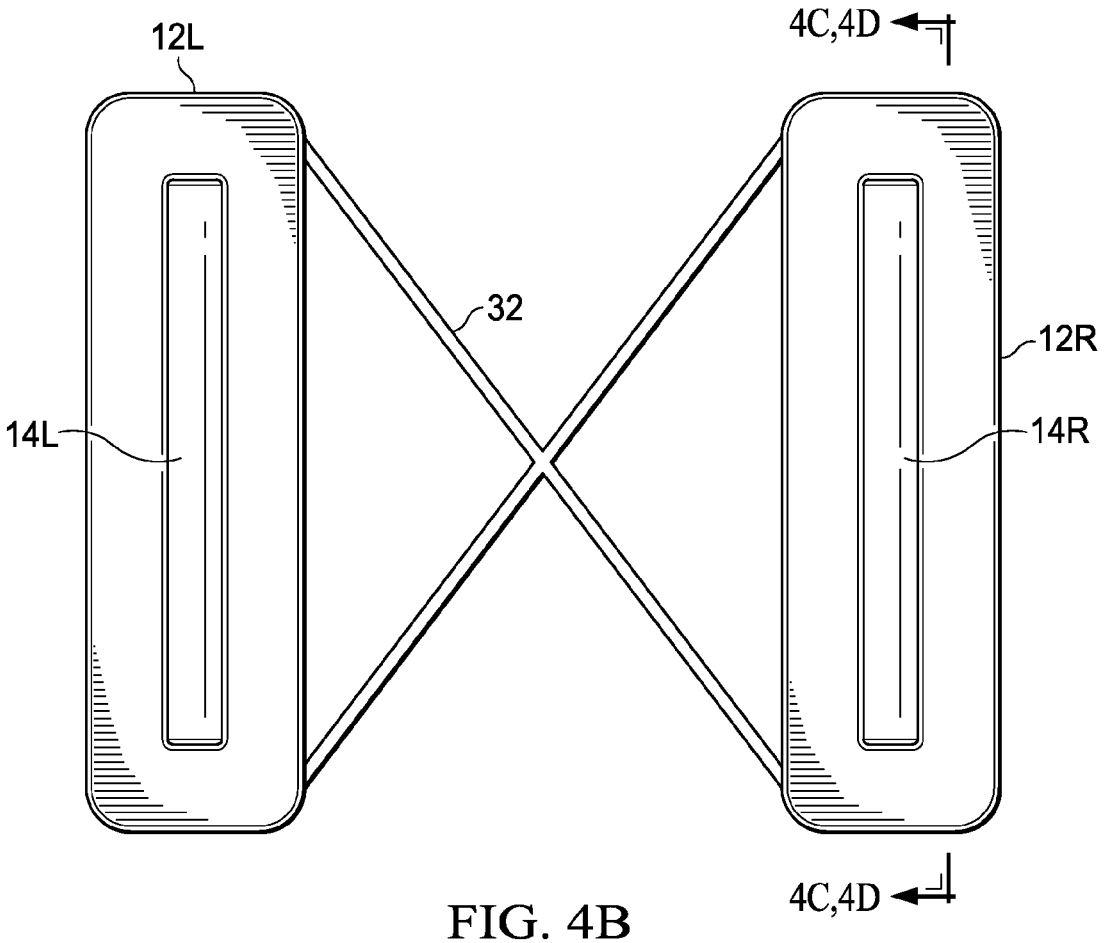

FIG. 4*b* illustrates another example of this embodiment of the invention, in which x-shaped brace 32 is attached between mounting pads 12L, 12R. As in the example of FIG. 4*a*, brace 32 maintains the desired distance between and alignment of tunnels 14L, 14R relative to one another, prior to attachment of mounting pads 12L, 12R to the article as desired by the user. It is contemplated that brace 32 may also be constructed of a flexible plastic, to enable mounting pads 12L, 12R to be attached to a wide variety of articles of various shape, as described above. Either or both of brace 32 and mounting pads 12L, 12R may be provided with an adhesive backing, or as an iron-on element, for attaching to the article by the user, as described above.

Figure 4C:
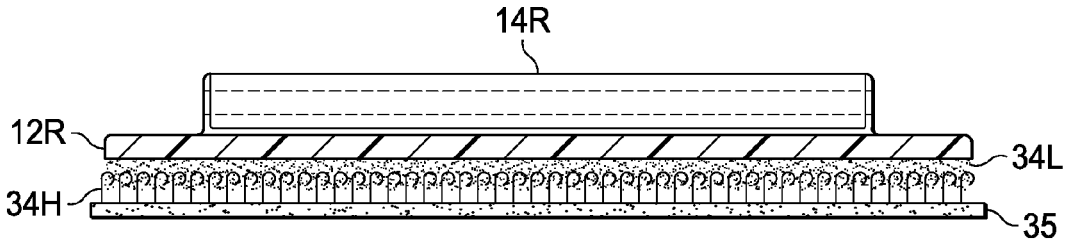
FIGS. 4*c* and 4*d* are elevation views of the mounting pad system illustrating alternative attachment subsystems, according to embodiments of the invention.

FIG. 4*c* illustrates, in elevation view, an example of another manner by way of which mounting pads 12L, 12R are attachable to an article. In the example of FIG. 4*c*, mounting pad 12R is attachable by way of a hook-and-loop attachment (e.g., a VELCRO fastener). In this example, mounting pad 12R is shown with tunnel 14R at its surface. Loop panel 34L is attached to the bottom side (i.e., backside in the view of FIG. 3*b*) of mounting pad 12R, and consists of a fabric strip having the desired density of fabric "loops" as useful for a hook-and-loop fastener, as known in the art. Hook panel 34H is a corresponding fabric strip having the appropriate number and density of plastic hooks at its surface, of a size suitable for mating with the loops of loop panel 34L, in the conventional manner for hook-and-loop fastener systems. In this embodiment of the invention, adhesive backing 35 is provided on the backside of hook panel 34H. Of course, hook panel 34H and loop panel 34L may be reversed if desired, such that hook panel 34H is attached to mounting pad 12R and loop panel 34L has adhesive backing 35, if desired.

Mounting pads 12L, 12R according to the implementation of FIG. 4*c* is performed by the user removing a protective film from the surface of adhesive backing 35 of hook panels 34H, and placing hook panels 34H at the desired locations of the article that is to receive the interchangeable panel system, referring to the spacing and alignment of mounting pads 12L, 12R as defined by brace 32. After adhering hook panels 34H to the article, mounting pads 12L, 12R may then be attached to the article by pressing loop panels 34L to hook panels 34H in the conventional manner for hook-and-loop fasteners.

Figure 4D:
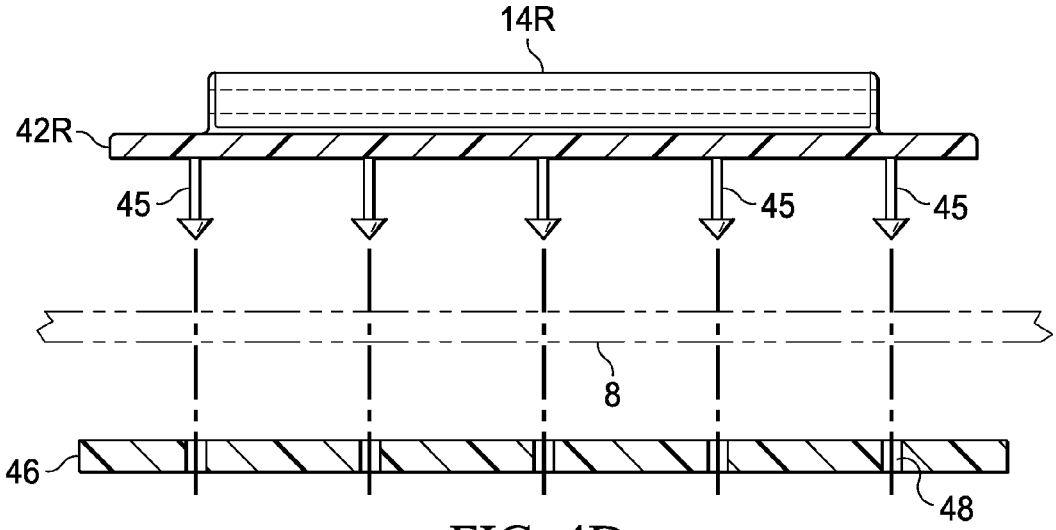

FIG. 4*d* illustrates another alternative approach for attaching mounting pads 42L, 42R to an article. In this implementation, mounting pads 42L, 42R are molded or constructed so as to have pins 45 extending from their bottom surfaces, opposite from tunnels 14L, 14R. Pins 45 each have a "barbed" pointed end, sufficiently sharp to poke through fabric 8 of the intended article to which the interchangeable panel system is to be attached. Back plate 46 is constructed of similar size, shape, and material as mounting pads 42L, 42R, for example of a flexible plastic, and has holes 48 defined therethrough at locations corresponding to the locations of pins 45 of mounting pads 42L, 42R.

To attach mounting pads 42L, 42R to the article, the user presses pins 45 through fabric 8 at the desired location of the article. Back plate 46 is then pressed a corresponding mounting pad 42L, 42R, such that pins 45 extend fully through holes 48. The barbed points at the ends of pins 45 can then "catch" on the back surface of back plate 46, holding the mounting pad 42L, 42R in position at the article.

Alternatively, if a smooth interior surface is desired (e.g., when mounting pads 42L, 42R are to be attached to a shoe or to jeans), back plate 46 may be constructed to be hollow, with holes 48 only on the surface of back plate 46 that is to face mounting plate 42L, 42R. In this implementation, the barbed point of pins 45 would be permitted to enter the interior of back plate 46 and "catch" on corresponding holes 48, but would not protrude through back plate 46 and cause discomfort to the wearer.

According to each of the embodiments of this invention described herein, the pin and tunnel fastening system provides a durable system for interchangeably attaching logos, graphics, and other designs to items of apparel, accessory items, and other articles, thus providing the user or wearer to enjoy displaying his or her own selected symbol of affinity, expressive content, ornamentation, on that same article. The content presented on the panels can vary widely, including collector panels, limited editions, seasonal designs, and the like. The interchangeability provided by embodiments of this invention also enables the user to change the design depending on the event being attended, mood, or for any reason.

As a result, the interchangeable panel system and its pin-and-tunnel construction provides a universal attachment mechanism that has a great deal of versatility, enabling the attachment of panels to a wide variety of articles. For example, it is contemplated that the interchangeable panel system of the embodiments of this invention enables the use of the same panel sizes and shapes on a wide variety of shoes (e.g., athletic shoes, casual shoes, including lace-up shoes, and the like), and also on other types of apparel and accessories that incorporate a compatible attachment system. This will allow the wearer to move panels among shoes and other item such as, but not limited to: baseball-style caps, belts, purses, backpacks, computer cases, jeans, lunch boxes, tote bags, gear bags and duffel, and gym bags, jackets, school binders, hair bows, headbands, stadium chairs, and the like. In addition, the interchangeability of the panels encourages consumers to trade panels with others who own and wear the panels.

In addition, it is contemplated that the pin and tunnel fastening system according to embodiments of the invention provides for numerous particular benefits. These benefits and advantages include an exact and secure panel placement every time that the decorative panel is changed, while maintaining a clean look. The system also provides a strong and secure attachment system that keeps the panels in place, while still allowing for easy and quick removal and attachment. The decorative panels useful with the system are quite versatile, and are contemplated to be useful on many types of clothing and accessories.

In addition, the interchangeable panel system described above according to embodiments of this invention enables one to change the particular panels on each article, as desired by the user; in addition, the user may move the same panels from one pair of shoes to another, or from shoes to backpack, or otherwise among a wide range of articles, as desired. The interchangeability of the panels also facilitates trading of panels among users. The content presented on the panels can vary widely, including collector panels, limited edition, seasonal designs, and the like.

While this invention has been described according to its embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. An interchangeable decorative panel system, comprising:

a decorative element, comprising:

a panel having first and second edges; and first and second pin members attached at a respective one of the first and second edges of the panel, each of the first and second pin members having a pin extending for a length in a direction substantially parallel that of the pin of the other of the first and second pin members; and first and second mounting pads, each having a longitudinal tunnel extending from a surface, the tunnel having a length corresponding to the length of the pin of the first and second pin members, respectively, and having an opening at an end for accepting the pin of its corresponding pin member.

2. The system of claim 1, wherein the first and second pin members and the first and second mounting pads are formed of a flexible plastic material.

3. The system of claim 1, wherein the pins of the first and second pin members are each tapered along its length from a narrow end to a wider end;

and wherein the tunnels of the first and second mounting pads are each tapered from a narrower end to a wider opening end.

4. The system of claim 1, wherein the pins of the first and second pin members each have a portion along its length that is tapered from a narrow end of the portion to a wider end;

and wherein the tunnels of the first and second mounting pads each have a tapered portion at a location corresponding to the tapered portion of the pin when fully inserted.

5. The system of claim 1, wherein each of the first and second pin members further comprises a tab extending one end of its pin.

6. The system of claim 5, wherein the tunnels of the first and second mounting pads each have a slot extending along a portion of the length of the tunnel for receiving the tab of its corresponding pin member.

7. The system of claim 1, wherein the panel comprises:

elastic portions disposed at the first and second edges to which the first and second pin members are respectively attached.

8. The system of claim 7, wherein the panel further comprises:

an ornamental label of a non-elastic material attached to its surface at a central location of the panel, so that elastic portions of the panel are disposed between edges of the ornamental label and the first and second pin members.

9. The system of claim 1, further comprising:

a brace disposed between the first and second mounting pads.

10. The system of claim 9, further comprising:

attachment means disposed on a backside of each of the first and second mounting pads, for attaching the first and second mounting pads to an article.

11. The system of claim 10, wherein the attachment means comprises:

an adhesive backing attached to the backside of each of the first and second mounting pads.

12. The system of claim 10, wherein the attachment means comprises:

hook-and-loop fasteners attached to the backside of each of the first and second mounting pads; and an adhesive backing attached to the hook-and-loop fasteners, for attaching to an article.

13. The system of claim 10, wherein a plurality of pins extend from the backside of each of the first and second mounting pads;

and wherein the attachment means comprises:

first and second base plates, each having holes therethrough corresponding to the location of the pins of the first and second mounting pads, respectively.

14. The system of claim 1, wherein each of the first and second mounting pads have a curvature to recess the tunnels from a surface of an article to which the mounting pads are attached.

15. An interchangeable decorative panel, comprising:

a decorative element, comprising:

a panel portion having first and second edges; and first and second pin members attached at a respective one of the first and second edges of the panel, each of the first and second pin members having a pin extending for a length in a direction substantially parallel that of the pin of the other of the first and second pin members;

wherein at least a portion of the pins of the first and second pin members are tapered from a narrow end to a wider end.

16. An interchangeable decorative panel, comprising:

a decorative element, comprising:

a panel portion having first and second edges; and first and second pin members attached at a respective one of the first and second edges of the panel, each of the first and second pin members having a pin extending for a length in a direction substantially parallel that of the pin of the other of the first and second pin members;

wherein each of the first and second pin members further comprises a tab extending one end of its pin.

17. An interchangeable decorative panel, comprising:

a decorative element, comprising:

a panel portion having first and second edges; and first and second pin members attached at a respective one of the first and second edges of the panel, each of the first and second pin members having a pin extending for a length in a direction substantially parallel that of the pin of the other of the first and second pin members;

wherein the panel portion comprises:

elastic portions disposed at the first and second edges to which the first and second pin members are respectively attached;

and further comprising:

an ornamental label of a non-elastic material attached to its surface at a central location of the panel, so that elastic portions of the panel are disposed between edges of the ornamental label and the first and second pin members.

* * * * *